United States Patent [19]

Clements

[11] Patent Number: 4,494,349

[45] Date of Patent: Jan. 22, 1985

[54] TRUSS STRUCTURE

[76] Inventor: Arthur C. Clements, 103 M. Midtown Bldg., Munoz Rivera, Hato Rey, San Juan, P.R. 00918

[21] Appl. No.: 402,777

[22] Filed: Jul. 28, 1982

[51] Int. Cl.[3] ..... E04C 5/06

[52] U.S. Cl. ..... 52/633; 52/648; 52/309.12

[58] Field of Search ..... 52/633, 648, 651, 655

[56] References Cited

U.S. PATENT DOCUMENTS 3,930,349 1/1976 Wellershaus ..... 52/648

FOREIGN PATENT DOCUMENTS 1434122 10/1969 Fed. Rep. of Germany ..... 52/648

*Primary Examiner*—J. Karl Bell

*Attorney, Agent, or Firm*—Sigalos & Levine

[57] ABSTRACT

A freestanding structural wall panel comprising a plurality of elongated spaced apart wire assemblies comprising first and second elongated wire members each formed into a continuous generally triangular shape, a first longitudinal wire member coupled to the lower apices of the first and second triangular wire members such that the apices of one triangular wire member are staggered with respect to the apices of the other triangular member and the planes of the first and second continuous triangular members form an angle with each other and second and third longitudinal wire members coupled to the upper apices of the first and second triangular wire members respectively, a layer of concrete partially embedding the wire members, and a layer of polyurethane foam formed for insulation purposes on the concrete layer and partially embedding the wire members whereby ducts, pipes and wiring may be placed under the non-embedded portion of the wire members and wall board may be attached to the wire members.

7 Claims, 12 Drawing Figures

TRUSS STRUCTURE

BACKGROUND OF THE INVENTION

The present invention relates to a freestanding monolithic wall panel for use in constructing a building and a truss structure for use in constructing the freestanding monolithic wall panel and includes a method of constructing a building utilizing the freestanding monolithic wall panel.

It is important that new and better methods of constructing buildings be found because of the increased cost of building materials and labor to use those materials in constructing a building. One of the prior art improvements in the construction of buildings has been the formation of modular wall panel units that can be prefabricated and put in place much like pieces of a puzzle in order to construct the building. These prefabricated modular wall panels have been constructed of wood, concrete, foamed material, plastics, and the like. Each of these particular materials have their own inherent problems associated with them. For instance, concrete is extremely heavy. However, the foam is so light that it doesn't have sufficient rigidity to withstand vertical loads and horizontal stresses applied thereto. If the foam panels are reinforced with steel, the time required to weld the reinforcement rods in the required form is time consuming and expensive. Still others connect a plurality of steel rods welded together longitudinally, diagonally, and transversely thus requiring several welds at one location which weakens the steel and is time consuming in construction.

Further, the use of such modular construction requires that the inside of the panel be used as an inside wall and thus requires either plastering or wall board to be attached thereto in some manner as well as making provision for space on the walls for wiring, plumbing, and duct work. In some cases, even the outer wall must be prepared to a finish state by using gunite or stucco for a finished appearance.

In all of these various systems, it is difficult to achieve a wall panel which is not only load bearing both horizontally and vertically but which will also provide a finished outer wall and make provisions for providing a finish wall on the inner surface thereof and do it in an economical manner in a reasonable time.

The present invention overcomes the disadvantages of the prior art by providing, first, a truss structure which is formed of a wire member and is so constructed that the welding thereof does not create weak points, which has sufficient structural strength to give a panel load bearing capabilities in both the vertical and horizontal directions and which is so constructed as to provide means on the inside panel surface to which a wall board can be attached and yet which has room under the truss structure to provide duct work, plumbing and electrical wiring.

Further, the truss structures may be utilized in a modular panel which can be constructed either at or away from the building site and which modular panel includes a layer of polyurethane foam for insulation purposes over the concrete and with the truss structure partially embedded in both the concrete and the overlying polyurethane layer so that that portion which protrudes can be used on which to mount wall board to form an inner wall.

Finally, these modular panel units may be erected vertically on a concrete pad below the surface level of the foundation of the structure to be built so that when the foundation of the structure is poured, the concrete and steel wire members in the foundation may interconnect with that portion of the truss not embedded in the concrete and polyurethane thus forming a wall of unitary construction with the foundation and which has the polyurethane extending below the level of the foundation to the concrete pad on which the wall is sitting thus providing a moistureproof insulation barrier which extends below the level of the foundation. The resulting wall combines speed of construction, permanence, insulation, ease of installation of utility service, and high quality finishes yet is moisture proof, pest proof, and fungus resistant and has the lowest weight to strength ratio of any known wall, thus providing protection from tornados or other storm damage.

SUMMARY OF THE INVENTION

The present invention relates to a truss structure comprising first and second elongated wire members each formed into a continuous, generally triangular shape, a first longitudinal wire member coupled to the lower apices of said first and second triangular wire members such that the apices of one triangular wire member are staggered with respect to the apices of the other triangular member and the planes of said first and second continuous triangular members form an angle with each other, and second and third longitudinal wire members coupled to the upper apices of said first and second triangular wire members respectively.

The present invention also relates to a freestanding structural wall panel comprising a plurality of elongated spaced apart wire members, a layer of concrete partially embedding said wire members, and a layer of polyurethane foam formed for insulation purposes on said concrete layer and partially embedding said wire members whereby ducts, pipes and wiring may be placed under the nonembedded portion of said wire members and wall board may be attached to said wire members to form a finished wall.

The invention furthers relates to a method of constructing a building comprising the steps of constructing a plurality of freestanding wall panels each having a plurality of spaced wire members partially embedded in a layer of concrete coated by a layer of polyurethane, pouring a concrete pad on which to place said wall panels to form the wall of said building, embedding a plurality of spaced dowels in and vertically projecting from said concrete pad, placing a plurality of said wall panels on said pad in side by side relationship to form a complete building wall, said vertically projecting dowels extending under the non-embedded portion of said wire members in said wall panel, pouring a concrete foundation which covers a part of said non-embedded portion of said wire members of said wall panels and said vertically projecting dowel, said foundation including a plurality of spaced dowels embedded in and horizontally projecting from said concrete foundation and connecting with said non-embedded portion of said wall panel wire members, placing a roof structure on the top of said wall panels, and attaching interior finish paneling to said non-embedded portion of said wall panel wire members whereby a building is constructed economically and in which the wall members have structural strength and are highly resistant to vertical loads and horizontal loads.

BRIEF DESCRIPTION OF THE DRAWINGS

These and other objects and advantages of the present invention will be disclosed in the course of the following specification, reference being had to the accompanying drawings, in which.

DETAILED DESCRIPTION OF THE DRAWINGS

Figure 1:
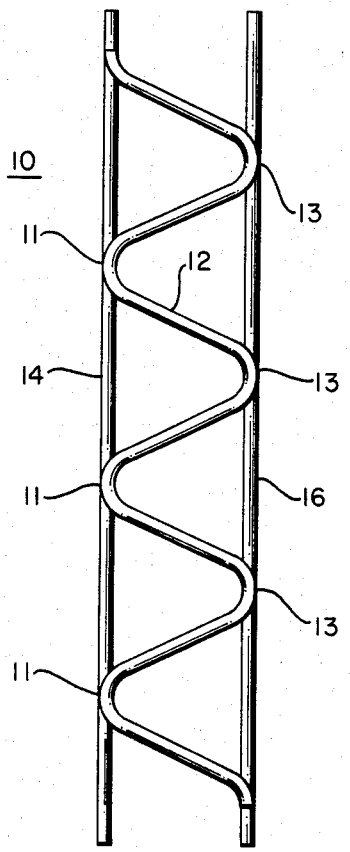
FIG. 1 PRIOR ART
FIG. 1 is a side view of a truss member of the prior art.

FIG. 1 is a side view of a typical prior art truss 10 which includes an elongated wire member 12 formed into a continuous, generally triangular shape which may be sinusoidal and to which is attached a first longitudinal wire member 14 at the upper apices 11 of the wire member 12 and a second longitudinal wire member 16 connected to the lower apices 13 of the wire member 12. The wire members 12, 14 and 16 are generally steel rods and, of course, may be attached to each other by means such as welding.

Figure 2:
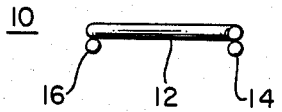
FIG. 2 PRIOR ART
FIG. 2 is an end view of the prior art truss member shown in FIG. 1.

FIG. 2 is an end view of the typical truss structure 10 as shown in FIG. 1 and, as can be seen in FIG. 2, the generally sinusoidal shaped wire member 12 is uniplanar. This type of truss, if used in a modular wall panel, does not provide sufficient strength to endure the required horizontal and vertical loading unless the truss units 10 are placed extremely close together. This, of course, would increase the cost of the modular units considerably. If they are not used in that manner then they must be connected by transverse rods at sufficient points to ensure strength and rigidity of construction. Such modular panel is shown in U.S. Pat. No. 3,305,991 to Weismann, issued Feb. 28, 1967. Again, such construction is expensive and time consuming in its manufacture.

Figure 3:
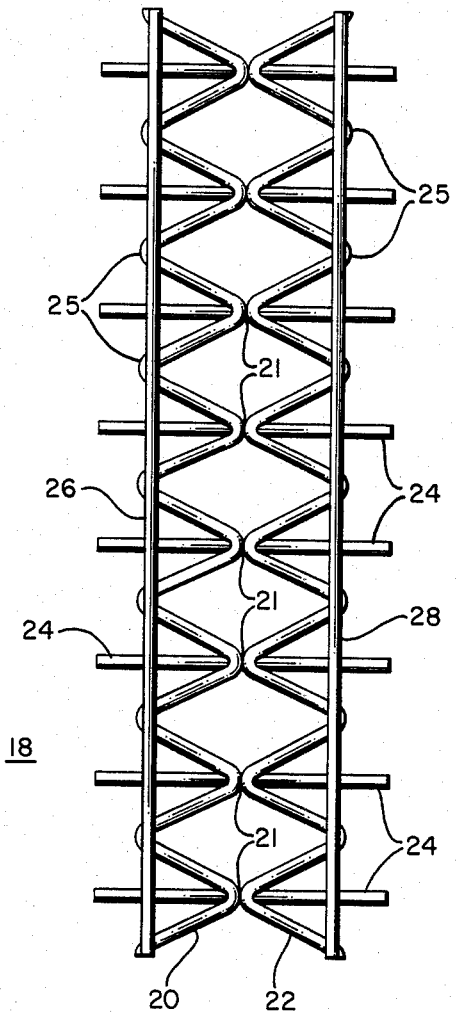
FIG. 3 PRIOR ART
FIG. 3 is a top view of a second prior art truss member.
Figure 4:
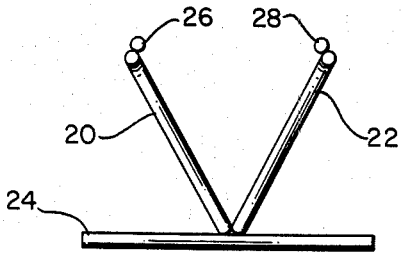
FIG. 4 PRIOR ART
FIG. 4 is an end view of the prior art truss member of FIG. 3.

Another type of prior art truss structure is shown in FIG. 3 in which the structure 18 comprises first and second elongated steel wire members 20 and 22 which are formed into a continuous generally triangular shape which may be sinusoidal as shown and whose lower apices 21 are welded together to a transverse rod 24 and the upper apices 25 of each wire member are respectively connected to a longitudinal wire member 26 or 28 by means such as welding. Thus, as can be seen in FIG. 4 which is an end view of the device shown in FIG. 3, the first and second elongated wire members 20 and 22 are each uniplanar and are coupled to each other at an angle and to transverse rod 24 by means of a weld. Such an arrangement is disclosed in U.S. Pat. No. 3,347,007 to J. R. Hale, issued Oct. 17, 1967.

Figure 5:
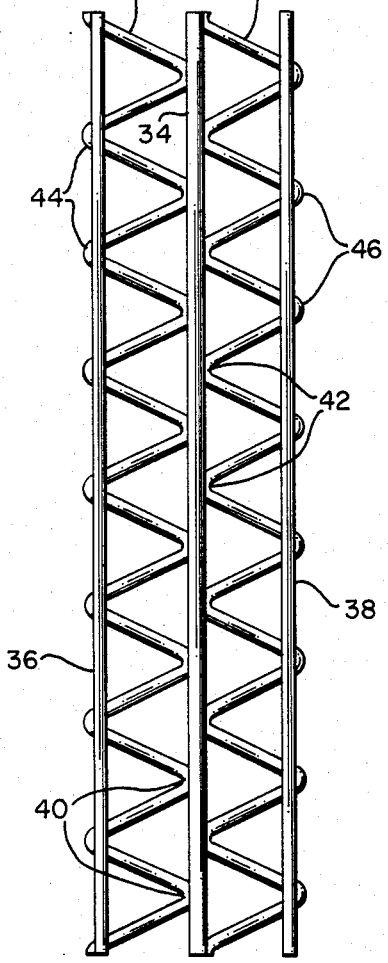
FIG. 5 is a top view of the truss member of the present invention.
Figure 6:
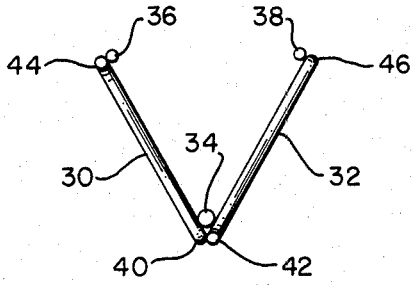
FIG. 6 is an end view of the truss view of the present invention which is shown in FIG. 5.

The novel truss structure of the present invention is disclosed in FIG. 5 which is a top view of the truss and which illustrates first and second elongated wire members 30 and 32 which are formed into a generally triangular shape and may be sinusoidal. The lower apices 40 and 42 of wire members 30 and 32 respectively are attached to elongated wire member 34 by any well known means such as by welding. The upper apices 44 of wire member 30 and upper apices 46 of wire member 32 are attached respectively to elongated wire members 36 and 38 by means such as welding. It will be noted that the apices 40 of wire member 30 are staggered with respect to the apices 42 of wire member 32 so that one weld only is formed at any one particular location. Not only does this prevent weakening of the elongated member 34 but the welds of alternate apices 40 and 42 are closer together than in the prior art thus in fact strengthening the truss member. As can be seen in FIG. 6, which is an end view of the truss structure shown in FIG. 5, each of the generally sinusoidal wire members 30 and 32 is uniplanar. It can also be seen that the lower longitudinal wire member 34 is larger in diameter than the upper longitudinal wire members 36 and 38. The larger bar 34 may for instance have a minimum diameter of 8 millimeters while the upper elongated bars 36 and 38 may have a minimum diameter of 5 millimeters. This gives added strength to the unit and, as will be seen hereinafter, it is rod 34 that will be exposed when the truss is partially embedded in concrete and polyurethane foam and to which the finish wall board will be attached in any well known manner such as by furr strips 78 shown in FIG. 10. Fusion welding of these units wherein the elongated wire members 30 and 32 lie in planes at an angle to each other as shown in FIG. 6 provides a unit with optimal structural properties wherein the bending resistance and the truss or column load bearing value are maximized relative to the quantity of steel used.

Figure 7:
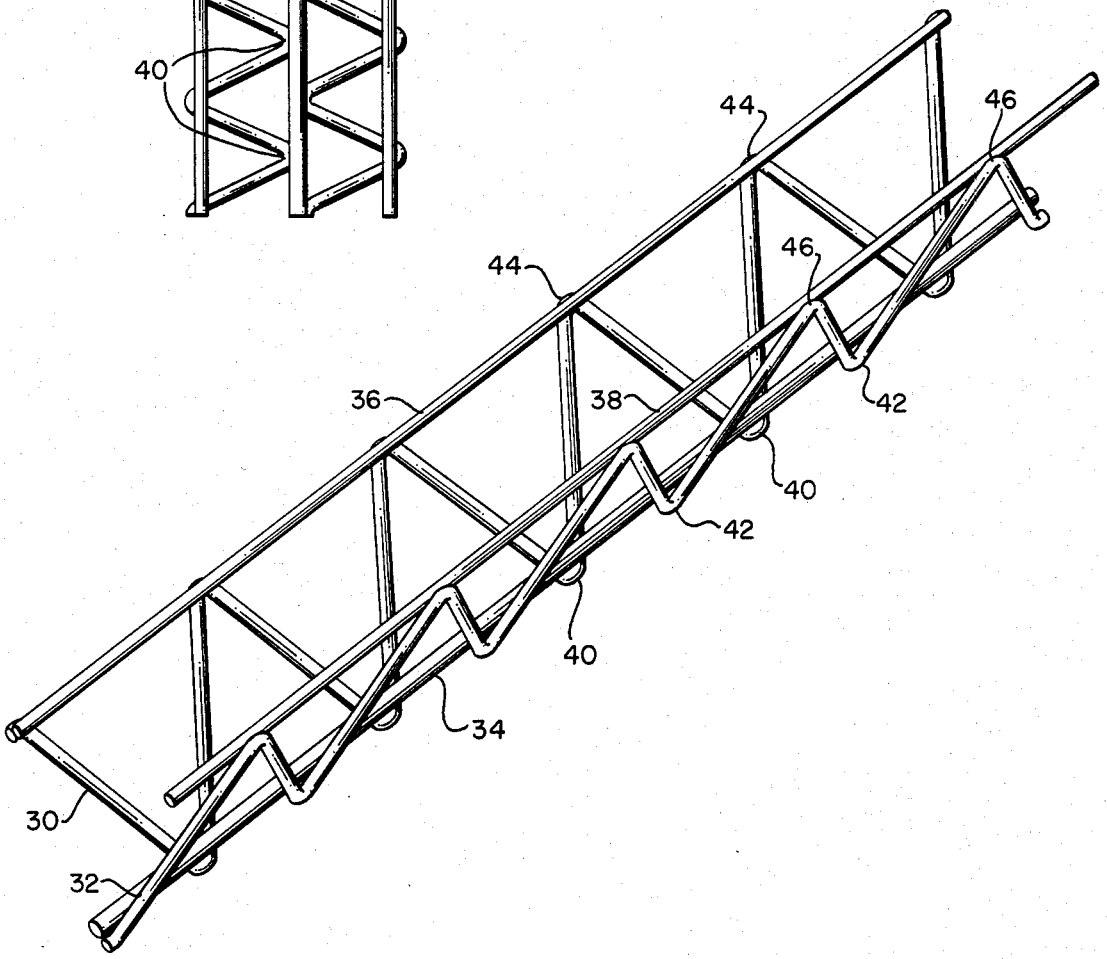
FIG. 7 is an isometric view of the truss member of the present invention.

FIG. 7 is a perspective view of the truss structure shown in FIGS. 5 and 6 so that it can be seen how the two elongated, sinusoidal shaped wire members 30 and 32 are attached to elongated rod 34 at their lower apices 40 and 42 respectively. It can be seen that the apices 40 and 42 are staggered or interleaved with respect to each other, that sinusoidal wire members 30 and 32 are at an angle with respect to each other and are attached at their upper apices 44 and 46 to elongated members 36 and 38 respectively.

Figure 8:
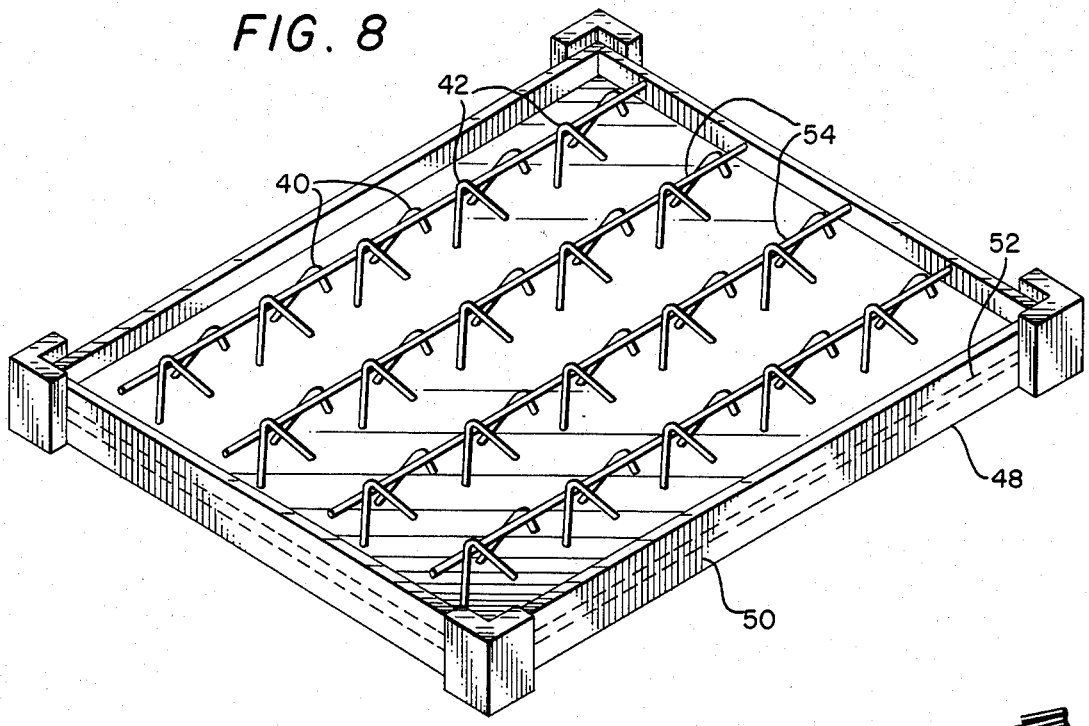
FIG. 8 is a perspective view of a freestanding structural wall panel of the present invention being constructed in a form.

The truss member shown in FIG. 7 may be used advantageously to construct a freestanding structural wall panel such as that shown in FIG. 8 which can be prefabricated either away from or at the job site where the building is to be constructed. The "on site" plant is ideal for tract work. The land area required is modest, control is good, and transportation is fast and inexpensive. Side boards 48 may be movable and thus can be readily adjusted to provide various widths of the panel as required. Once the forms 48 are properly set to the required size, approximately two inches of ready mix concrete 50 is poured into the form. A vibrating screed may be used to finish the concrete and the finish is to be even and rough. No special troweling is required. A layer of polyurethane 52 approximately one inch thick can be sprayed or foamed in place on the panel in the form before stripping the forms. Spraying is the preferable method since, during the process, the steel truss structure is coated with the polyurethane which prevents the structure from rusting or oxidizing because it is anti-corrosive. Further, in areas where it is not required to extend the moisture proof polyurethane barrier below the foundation, the polyurethane may be sprayed on the walls after they are erected. Green concrete can be primed to receive this application for perfect bond between concrete and foam. Panel forms 48 can be poured and stripped daily. The required truss structures 54 are, of course, placed in the forms prior to pouring of the concrete and the spraying or foaming of the polyurethane. These truss structures are identical to that shown in FIG. 7 wherein the exposed longitudinal rod in FIG. 8 to which the apices 40 and 42 are attached is rod 34 in FIG. 7.

Figure 9:
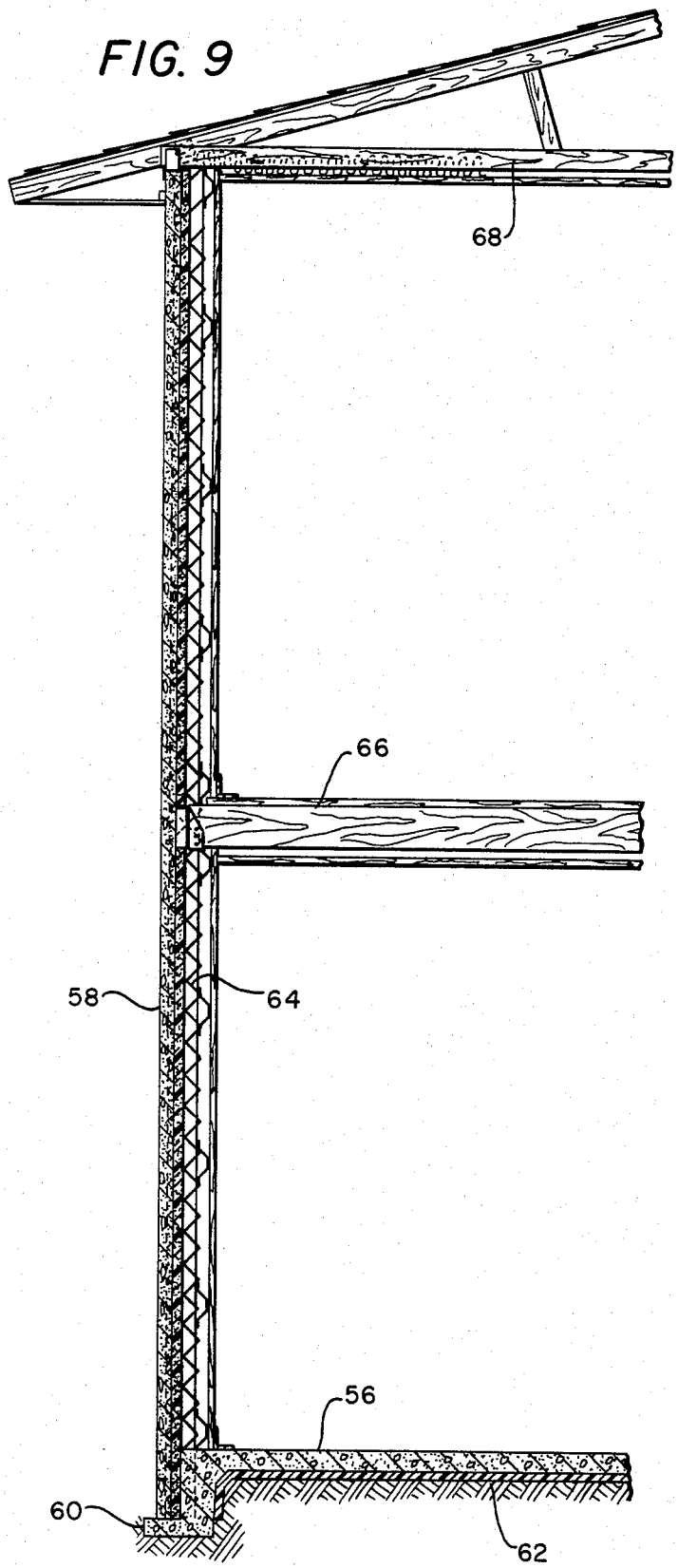
FIG. 9 is a cross sectional side view of a building wall constructed with the freestanding wall panel of the present invention.

FIG. 9 is a cross sectional side view of a wall of a structure built with the modular monolithic panels of the present invention. In order to form a structural shell in which the floor slab 56 and the walls 58 are monolithically connected, it is required that a concrete leveling sill or pad 60 be formed for the exterior walls. This pad 60 is located below the grade level 62 on which the foundation slab 56 is to be laid. Once pad 60 has been set, the precast wall panels 58 are lifted in place and set on the pad 60. With the wall panels 58 in that position, the foundation 56 is poured such that the concrete abutts the polyurethane foam layer on the monolithic wall 58 and embedds the exposed portion of the metal truss 64 of wall 58. When poured as shown in detail in FIG. 12, the foundation slab and the monolithic wall portions 58 become monolithically connected to form a structural shell. A second floor 66 and a roof truss 68 may be added as shown in detail in FIG. 10 and FIG. 11.

Figure 10:
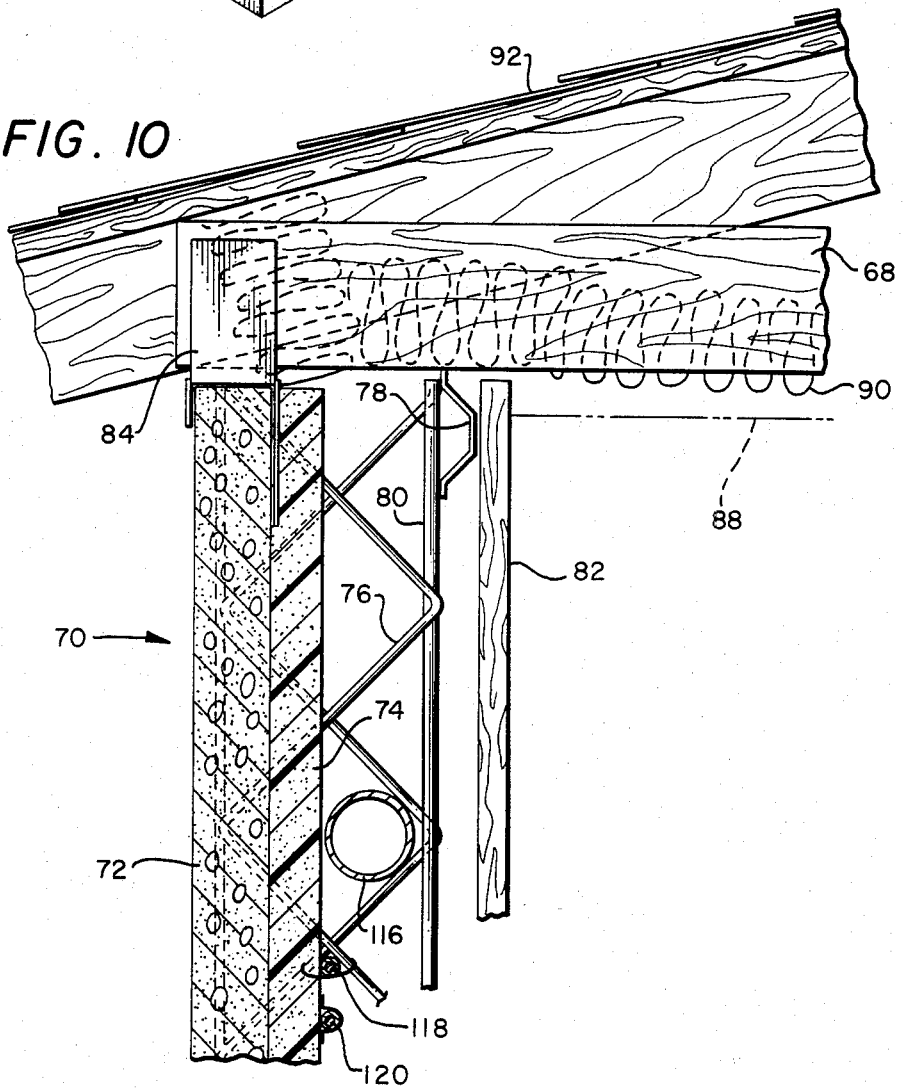
FIG. 10 is an enlarged partial cross-sectional view of the top of the wall panel illustrated in FIG. 9 showing the details of construction of the roof portion of the building with respect to the freestanding wall panel.

As shown in FIG. 10, the freestanding structural wall generally designated as 70 includes the two inches of concrete 72 and the one inch of polyurethane foam 74 in both of which the truss structure 76 is partially embedded. Furr strips 78 are attached in any well known manner (such as wire clips) to the elongated bar 80 forming part of the truss or lattice structure 76. Wall board 82 may then be fastened to the furr strips 78 in a well known manner to form a finished wall on the interior of the structure. Galvanized steel connection uplift clips 84 connect the roof truss 68 to the freestanding structural wall panel 70. The finished ceiling 88 is attached in any well known manner and insulation batting 90 is placed above the finished ceiling for insulation purposes. The wood roof deck 92 is also attached in a manner well known in the art. Further, any required duct work 116, pipes 118 or electrical wiring 120 may be placed in the space under wall board 82 formed by the exposed portion of truss or lattice structure 76. Insulation (not shown) may also fill that space if necessary.

Figure 11:
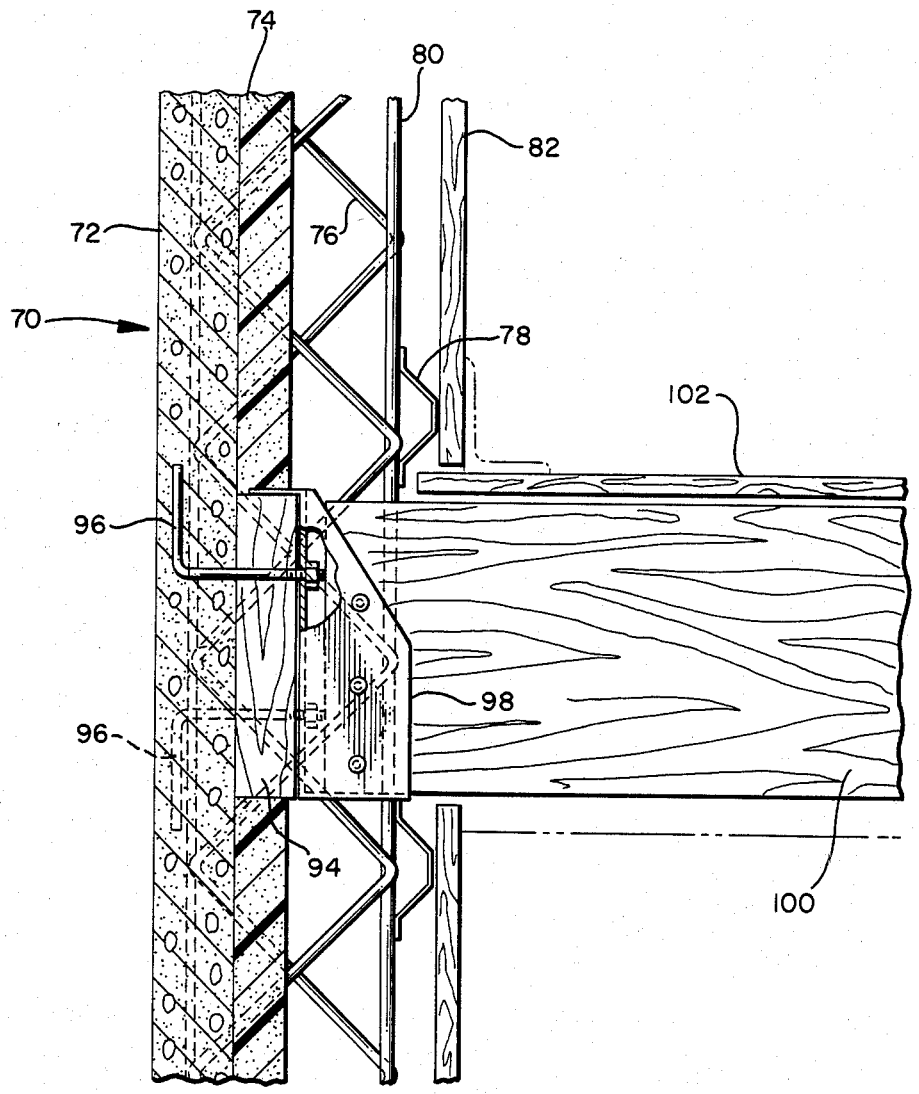
FIG. 11 is a partial cross sectional view of a wall panel as in FIG. 9 illustrating the details of attaching a second floor to the wall panel.

FIG. 11 is a cross sectional view of the freestanding structural wall panel 70 to which a second or intermediate floor is attached. As can be seen in FIG. 11, a two inch board 94 is pre-applied to the wall structure 70 and connected by bolts 96 which are set in the precast concrete 72. A galvanized steel joist hanger 98 is connected to the board 94 and floor joists 100 are attached thereto. The finished floor 102 is, of course, attached to the upper portion of floor joists 100.

Figure 12:
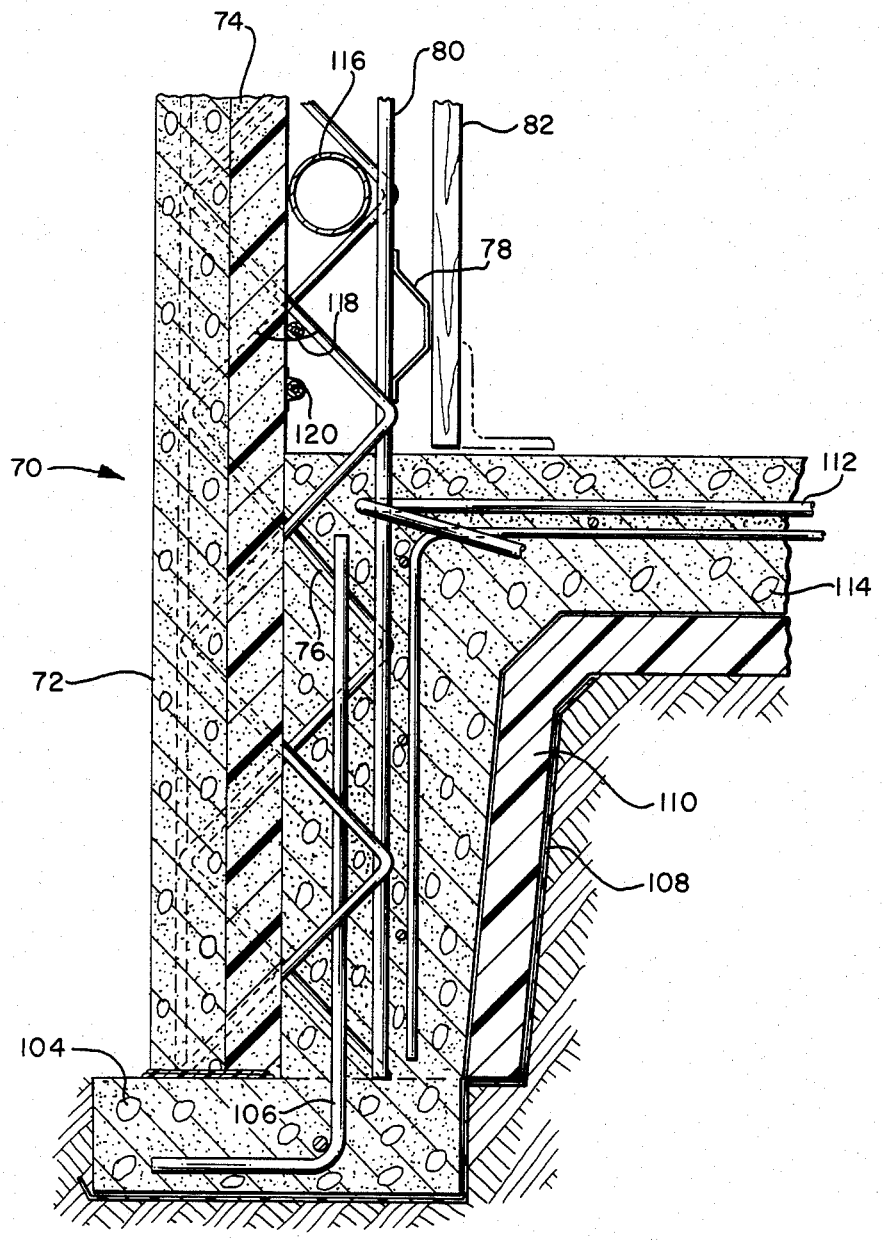
FIG. 12 is a partial cross sectional view of the bottom of the modular wall panel shown in FIG. 9 and the manner in which it interconnects with the foundation of the wall structure shown in FIG. 9.

FIG. 12 is a detailed cross sectional view of the area in which the concrete foundation 114 is joined to the freestanding structural wall panel 70. As can be seen in FIG. 12, the concrete leveling sill or pad 104 is poured and has projecting vertically therefrom dowels 106 which are used for anchors. These dowels protrude vertically from the concrete leveling sill or pad 104 and are adjacent the non-embedded portion 76 of the truss or lattice to firmly secure the wall 70 to base pad 104 when the foundation concrete 114 is poured. When the precast freestanding structural wall panel 70 is raised and placed on leveling pad 104, it is braced and held in place until the foundation can be poured. First, a floor moisture barrier 108 is laid down if necessary. Next, a floor slab insulation 110 is placed over the moisture barrier 108 if the slab insulation 110 is necessary. Next, steel anchor dowels 112 are hooked around the longitudinal bar 80 which forms a part of the steel truss 76 which forms a part of the freestanding structural wall panel 70. When the concrete 114 is poured, it not only ties the freestanding wall structure 70 to base pad 104 by means of vertically projecting dowel 106 as set forth above, but it also attaches in a monoiithic manner the freestanding structural wall panel 70 to the concrete foundation 114 through anchor dowel 112. It will be noted that the polyurethane foam 74, which is a moisture barrier, extends downwardly between the foundation concrete 114 and the structural wall concrete 72 down to leveling pad 104 thus forming a complete moisture barrier for the structure being erected. Again, the interior wall board 82 may be attached to elongated steel bar 80 by means of furr strips 78.

Thus, it can be seen that a structure can be quickly and easily erected through the use of the novel freestanding structural wall panel 70 which can be prefabricated as a modular wall unit or panel utilizing a novel structural steel truss 76 and two inches of concrete 72 on which is sprayed or foamed a one inch layer of polyurethane foam 74 for insulation purposes. It will be noted in FIGS. 10 and 12 that the duct work 116, piping 118 and electrical wiring 120 is easily located in the space created by the exposed portion of the lattice structure 76, the polyurethane foam 74 and the interior wall board 82. Further, that same space can be filled with additional insulation should it be deemed necessary.

Thus the applications described herein concentrate on a bearing wall structure and the unique truss structure which allows buildings to be constructed with lower costs, less labor and materials, higher speed of construction, ease of placing services and duct work, ease of connection to other items such as balconies, precast curtain walls, precast elevator shafts, stairs, and the like, and providing construction which has a structural wall with both vertical and horizontal load bearing capabilities.

It is understood that suitable modifications may be made in the structure as described and disclosed herein provided that such modifications, come within the spirit and scope of the appended claims.

Having now, therefore, fully illustrated and described my invention, what I claim to be new and desire to protect by Letters Patent is:

1. A truss structure comprising:
   a. first and second elongated wire members each formed into a continuous generally triangular shape,
   b. a first longitudinal wire member coupled to the lower apices of said first and second triangular wire members such that the apices of one triangular wire member are staggered with respect to the apices of the other triangular member and the planes of said first and second continuous triangular members form an angle with each other, and
   c. second and third longitudinal wire members coupled to the upper apices of said first and second triangular wire members respectively.

2. A truss structure as in claim 1 wherein said apices of said first and second triangular wire members are welded to said first, second and third longitudinal wire members.

3. A truss structure as in claim 2 wherein said generally triangular shape of said wire members is sinusoidal.

4. A truss structure as in claim 3 wherein each of said generally sinusoidal wire members is uniplanar.

5. A truss structure as in claim 4 wherein said first longitudinal wire member is larger in diameter than said second and third longitudinal wire members.

6. A truss structure comprising:
   a. first and second serpentine shaped, elongated wire members,
   b. first, second and third elongated longitudinal bars, one of which bars is larger in thickness than the others, and
   c. means for coupling one set of apices of each of said serpentine wire members in staggered configuration to said larger bar and the other set of apices to a respective one of said remaining bars such that the first and second wire members are at an angle with each other.

7. A truss structure as in claim 6 wherein:
   a. said large elongared bar is 8 millimeters in diameter, and
   b. said two smaller elongated bars are 5 millimeters in diameter.

* * * * *